US010077131B2

(12) United States Patent
Lettre et al.

(10) Patent No.: US 10,077,131 B2
(45) Date of Patent: Sep. 18, 2018

(54) DIVIDER FOR PACKAGE

(71) Applicant: Graphic Packaging International, Inc., Atlanta, GA (US)

(72) Inventors: Neil Lettre, Marietta, GA (US); Robert L. Sutherland, Kennesaw, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 310 days.

(21) Appl. No.: 15/019,305

(22) Filed: Feb. 9, 2016

(65) Prior Publication Data

US 2016/0152374 A1 Jun. 2, 2016

Related U.S. Application Data

(62) Division of application No. 13/935,802, filed on Jul. 5, 2013, now Pat. No. 9,284,090.

(60) Provisional application No. 61/690,998, filed on Jul. 9, 2012.

(51) Int. Cl.

| | |
|---|---|
| ***B65D 5/49*** | (2006.01) |
| ***B65D 71/10*** | (2006.01) |
| ***B65B 11/00*** | (2006.01) |

(52) U.S. Cl.

CPC ..... *B65D 5/48024* (2013.01); *B65B 11/00* (2013.01); *B65D 5/48034* (2013.01); *B65D 71/10* (2013.01)

(58) Field of Classification Search

CPC .. B65D 2571/0066; B65D 2571/00141; B65D 71/36; B65D 71/10; B65D 71/08; B65D 5/48024; B65D 5/48048

USPC ..... 206/139, 432, 503, 821; 53/398

See application file for complete search history.

(56) References Cited

U.S. PATENT DOCUMENTS

| | | | | |
|---|---|---|---|---|
| 1,120,752 | A | 12/1914 | Smiley | |
| 1,896,326 | A | 2/1933 | Northway-Ley | |
| 1,896,646 | A | 2/1933 | Taylor | |
| 2,312,846 | A | 3/1943 | Olvey | |
| 2,475,107 | A | 7/1949 | Newsom | |
| 2,844,294 | A | 7/1958 | Williams | |
| 2,875,942 | A | 3/1959 | Wilson | |
| 3,101,880 | A | 8/1963 | Peterson | |
| 3,158,312 | A | 11/1964 | Simkins | |
| 3,302,784 | A | 2/1967 | Copping | |
| 3,385,429 | A * | 5/1968 | Becker | B65D 71/10 206/139 |

(Continued)

FOREIGN PATENT DOCUMENTS

| | | |
|---|---|---|
| CH | 263456 | 8/1949 |
| DE | 88 14 144.6 | 1/1989 |

(Continued)

OTHER PUBLICATIONS

Office Action for U.S. Appl. No. 13/935,802 dated Apr. 8, 2015.

(Continued)

*Primary Examiner* — Nathaniel Chukwurah

(74) *Attorney, Agent, or Firm* — Womble Bond Dickinson (US) LLP

(57) ABSTRACT

A divider for dividing at least two layers of articles in a package. The divider comprises a central panel, and at least one article attachment flap foldably connected to the central panel. The at least one article attachment flap is for attaching the divider to at least one of the articles as the divider and the articles are formed into the package.

9 Claims, 8 Drawing Sheets

(56) References Cited

U.S. PATENT DOCUMENTS

| | | | | |
|---|---|---|---|---|
| RE27,212 | E | 11/1971 | Brown | |
| 3,817,373 | A | 6/1974 | Samsing | |
| 3,822,785 | A | 7/1974 | Getz et al. | |
| 3,937,326 | A | 2/1976 | Schick | |
| 4,105,154 | A | 8/1978 | Meyers et al. | |
| 4,120,443 | A | 10/1978 | Gardner et al. | |
| 4,421,229 | A | 12/1983 | Pan et al. | |
| 4,577,799 | A | 3/1986 | Oliff | |
| 4,919,265 | A * | 4/1990 | Lems | B65B 11/008 206/432 |
| 4,919,269 | A | 4/1990 | Wright | |
| 4,932,528 | A | 6/1990 | Benno | |
| 5,234,102 | A | 8/1993 | Schuster et al. | |
| 5,246,113 | A | 9/1993 | Schuster | |
| 5,415,344 | A | 5/1995 | Harrelson | |
| 5,427,242 | A | 6/1995 | Oliff et al. | |
| 5,437,143 | A | 8/1995 | Culpepper et al. | |
| 5,518,111 | A * | 5/1996 | Stout | B65D 71/36 206/160 |
| 5,620,094 | A | 4/1997 | Naumann | |
| 5,669,500 | A | 9/1997 | Sutherland | |
| 5,682,984 | A | 11/1997 | Hoell et al. | |
| 5,687,847 | A | 11/1997 | Culpepper et al. | |
| 5,699,957 | A | 12/1997 | Blin et al. | |
| 5,772,030 | A | 6/1998 | Baxter | |
| 5,826,783 | A | 10/1998 | Stout | |
| 5,826,870 | A | 10/1998 | Vulgamore et al. | |
| 5,848,686 | A | 12/1998 | Dean | |
| 5,868,252 | A | 2/1999 | Oliff | |
| 5,938,109 | A | 8/1999 | Sainz et al. | |
| 5,957,288 | A | 9/1999 | Campbell | |
| 5,967,406 | A | 10/1999 | Moorman | |
| 5,996,883 | A | 12/1999 | Bates | |
| 6,012,630 | A | 1/2000 | Block | |
| 6,105,776 | A | 8/2000 | Meilhon | |
| 6,112,977 | A | 9/2000 | Sutherland et al. | |
| 6,176,419 | B1 | 1/2001 | Holley, Jr. | |
| 6,244,502 | B1 | 6/2001 | Hollar et al. | |
| 6,386,369 | B2 | 5/2002 | Yuhas et al. | |
| 6,394,272 | B1 | 5/2002 | Domansky | |
| 6,499,596 | B1 | 12/2002 | Andersen et al. | |
| 6,918,487 | B2 | 7/2005 | Harrelson | |
| 6,991,107 | B2 | 1/2006 | Harrelson | |
| 7,093,713 | B2 | 8/2006 | Sutherland | |
| 7,168,558 | B2 | 1/2007 | Harrelson | |
| 7,195,118 | B2 | 3/2007 | Sutherland | |
| 7,475,778 | B2 | 1/2009 | Sutherland | |
| 7,661,527 | B2 | 2/2010 | Cerf | |
| 7,717,321 | B2 | 5/2010 | Spivey, Sr. et al. | |
| 8,127,980 | B2 | 3/2012 | Spivey, Sr. et al. | |
| 8,459,535 | B2 | 6/2013 | Brand | |
| 9,284,090 | B2 | 3/2016 | Lettre | |
| 2004/0155098 | A1 | 8/2004 | Harrelson | |
| 2004/0245327 | A1 | 12/2004 | Oliff et al. | |
| 2005/0115843 | A1 | 6/2005 | Harrelson | |
| 2005/0167292 | A1 | 8/2005 | Sutherland | |
| 2006/0180488 | A1 | 8/2006 | Spivey, Sr. et al. | |

FOREIGN PATENT DOCUMENTS

| | | |
|---|---|---|
| DE | 91 11 941.3 | 1/1992 |
| EP | 0 595 602 | 5/1994 |
| FR | 1427897 | 4/1966 |
| FR | 1489087 | 7/1967 |
| FR | 1497652 | 10/1967 |
| FR | 2223985 | 10/1974 |
| GB | 434145 | 8/1935 |
| GB | 2 198 709 | 6/1988 |
| GB | 2 323 352 | 9/1998 |
| JP | 62-130024 | 8/1987 |
| JP | 1-73121 | 5/1989 |
| JP | 7-125745 | 5/1995 |
| JP | 9-142449 | 6/1997 |
| JP | 11-130049 | 5/1999 |
| JP | 2000-85754 | 3/2000 |
| JP | 2000-238779 | 9/2000 |
| WO | WO 92/07772 | 5/1992 |
| WO | WO 96/29261 | 9/1996 |
| WO | WO 00/20288 | 4/2000 |
| WO | WO 01/30659 | 5/2001 |
| WO | WO 02/030764 | 4/2002 |
| WO | WO 2004/014755 | 2/2004 |

OTHER PUBLICATIONS

Response to Restriction Requirement for U.S. Appl. No. 13/935,802 dated May 8, 2015.
Office Action for U.S. Appl. No. 13/935,802 dated Jun. 19, 2015.
Amendment A and Response to Office Action for U.S. Appl. No. 13/935,802 dated Sep. 15, 2015.
Notice of Allowance and Fee(s) Due for U.S. Appl. No. 13/935,802 dated Nov. 10, 2015.
Issue Fee Transmittal Form for U.S. Appl. No. 13/935,802 dated Feb. 9, 2016.
Issue Notification for U.S. Appl. No. 13/935,802 dated Feb. 24, 2016.

* cited by examiner

DIVIDER FOR PACKAGE

CROSS-REFERENCE TO RELATED APPLICATIONS

This application is a divisional of U.S. patent application Ser. No. 13/935,802, filed Jul. 5, 2013, which claims the benefit of U.S. Provisional Patent Application No. 61/690,998, filed Jul. 9, 2012.

INCORPORATION BY REFERENCE

The disclosures of U.S. patent application Ser. No. 13/935,802, which was filed on Jul. 5, 2013, and U.S. Provisional Patent Application No. 61/690,998, which was filed on Jul. 9, 2012, are hereby incorporated by reference for all purposes as if presented herein in their entirety.

BACKGROUND OF THE DISCLOSURE

The present disclosure generally relates to dividers for use in a package containing beverage containers or other types of articles.

SUMMARY OF THE DISCLOSURE

In one aspect, the disclosure is generally directed to a divider for dividing at least two layers of articles in a package. The divider comprises a central panel, and at least one article attachment flap foldably connected to the central panel. The at least one article attachment flap is for attaching the divider to at least one of the articles as the divider and the articles are formed into the package.

In another aspect, the disclosure is generally directed to a package. The package can comprise a plurality of articles arranged in a first layer of articles and a second layer of articles. The first layer of articles can define at least one gap between at least two articles of the plurality of articles. The package can further comprise a divider comprising a central panel and at least one article attachment flap foldably connected to the central panel. The at least one article attachment flap can extend at least partially into the at least one gap.

In another aspect, the disclosure is generally directed to a method of forming a package having a divider between at least two layers of articles. The method can comprise obtaining a divider comprising a central panel and at least one article attachment flap foldably connected to the central panel, obtaining a plurality of articles, and arranging the plurality of articles into at least a first layer of articles and a second layer of articles. The first layer of articles can define at least one gap between at least two articles of the plurality of articles. The method can further comprise positioning the central panel of the divider against the first layer of articles, and folding the at least one article attachment flap relative to the central panel so that the at least one article attachment flap extends at least partially into the at least one gap.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the belowlisted drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE D WINGS

Corresponding parts are designated by corresponding reference numbers throughout the drawings.

DETAILED DESCRIPTION OF THE EXEMPLARY EMBODIMENTS

The present disclosure generally relates to packages or cartons that contain a plurality of articles such as containers, bottles, cans, etc. The article(s) can be used for packaging food and beverage products, for example, or any other item. The article(s) can be made from materials suitable in composition for packaging the particular food or beverage item, or other item, and the materials can include, but are not limited to, aluminum and/or other metals; glass or other breakable material; plastics such as PET, LDPE, LLDPE, HDPE, PP, PS, PVC, EVOH, and Nylon; paperboard; and the like, or any combination thereof, or any other suitable material.

Dividers, packages, constructs, or cartons according to the present disclosure can accommodate articles of any shape. For the purpose of illustration and not for the purpose of limiting the scope of the disclosure, the following detailed description describes beverage containers (e.g., aluminum beverage cans) as depicted in the various illustrated embodiments. In this specification, the terms "lower," "bottom," "upper," and "top" indicate orientations determined in relation to fully erected and upright cartons.

Figure 1:
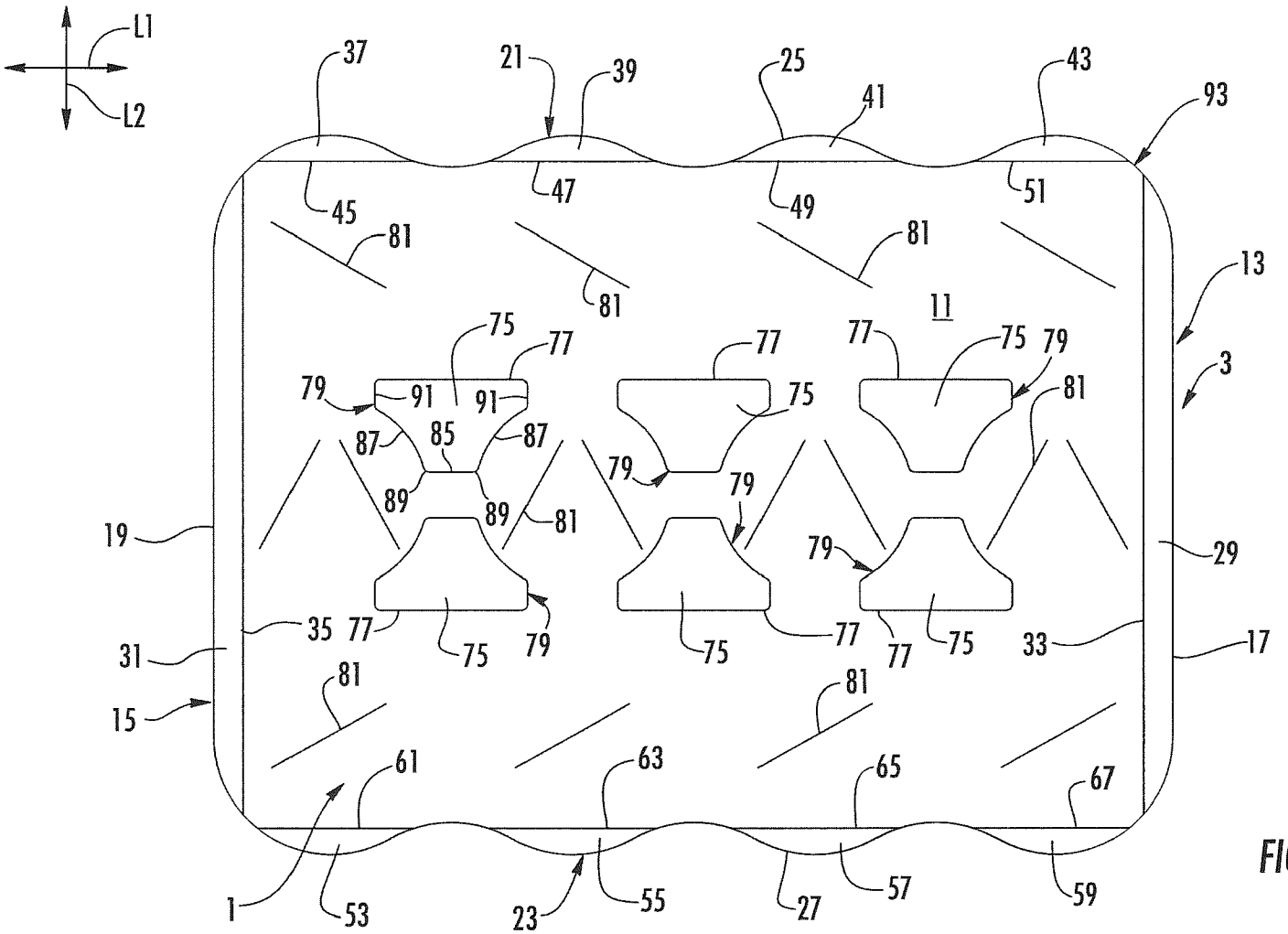
FIG. 1 is an exterior plan view of a blank for forming a divider according to an exemplary embodiment of the disclosure.

FIG. 1 is a plan view of the exterior side 1 of a blank, generally indicated at 3, used to form a construct or divider 5 (FIGS. 3-8) according to one exemplary embodiment of the disclosure. The blank 3 has a longitudinal axis L1 and a lateral axis L2. The divider 5 can be used in a package 7 (FIGS. 7 and 8) between two layers of containers C. In one embodiment, the stacked layers of containers with the divider therebetween can be secured together by an overwrap of shrink-wrap (e.g., shrinkable polymer film) or other packaging material M (FIG. 8) so that the divider 5, containers C, and packaging material form the package 7. The divider 5 contacts the tops of the containers C in the first or bottom layer 8 (FIGS. 2-4 and 6-8) and supports the bottoms of the containers C in the second or top layer 9 (FIGS. 7 and 8) to stabilize the package and allow transport of the package.

In the illustrated embodiment the containers C are beverage cans, but the containers could be other types of containers suitable to be arranged in two stacked layers (soup cans, pet food cans, etc.) without departing from the disclosure. In the illustrated embodiment, the divider 5 is sized for use in a package holding twenty-four containers C in two layers, each layer being arranged in a 3×4 arrangement so that the package 7 can be referred to as a 3×4×2 arrangement of containers, but it is understood that the divider and package may be sized and shaped to hold containers of a different or same quantity in more than one layer and/or in different row/column arrangements (e.g., 1×6, 2×6, 4×6, 3×8, 2×6×2, 3×6×2, 2×9, 3×4, etc.). In the illustrated embodiment, each of the containers C can include a top T, a bottom B, shoulder S, and a generally cylindrical body portion BP extending between the shoulder S and the bottom B. The containers C could be otherwise shaped, arranged, configured, and/or omitted without departing from the disclosure.

In one embodiment, the blank 3 has a central panel 11 having a first end 13 and a second end 15, with each end having a respective generally straight edge 17, 19. The blank 3 has a first side 21 and a second side 23, with each side having a respective generally curved edge 25, 27. The blank 3 has an end flap 29, 31 at each respective end 13, 15 that is foldably connected to the central panel 11 at a respective fold line 33, 35 that is spaced in from a respective generally straight edge 17, 19. The side 21 of the blank 3 comprises four side end flaps 37, 39, 41, 43 respective foldably connected to the central panel 11 at respective fold lines 45, 47, 49, 51. Similarly, the side 23 has four side end flaps 53, 55, 57, 59 foldably connected to the central panel 11 at respective fold lines 61, 63, 65, 67. In one embodiment, the fold lines 33, 35, 45, 47, 49, 51, 61, 63, 65, 67 are formed by cut lines having spaced apart nicks, but it is understood that the fold lines could be other forms of weakening (e.g., crease or score lines, cut/crease lines, etc.). The central panel 11 and the end flaps 29, 31, 37, 39, 41, 43, 53, 55, 57, 59 could be otherwise shaped, arranged, configured, and/or omitted without departing from the disclosure.

As shown in FIG. 1, the central panel 11 has article attachment flaps 75 foldably connected to the central panel at respective fold lines 77. In the illustrated embodiment, the central panel has two rows of three attachment flaps 75, but the attachment flaps could be otherwise arranged without departing from the disclosure. The attachment flaps 75 are shaped and positioned to fit in between gaps G (FIG. 2) between adjacent containers C arranged in the bottom layer 8. In the illustrated embodiment, each of the attachment flaps 75 can be at least partially defined by a respective tear or cut line 79 in the central panel 11. As shown in FIG. 1, the cut lines 79 can form a longitudinal edge 85, two concave curved edges 87 extending from respective ends 89 of the longitudinal edge 85, and two lateral edges 91 extending from the respective curved edges 87 in each attachment flap 75. In the illustrated embodiment, the fold line 77 for each attachment flap 75 is a longitudinal fold line, and the lateral edges 91 extend from respective ends of the longitudinal fold line 77. As shown in FIG. 1, the article attachment flaps 75, including the longitudinal fold lines 77 and the cut lines 79, are spaced apart from an outer periphery 93 of the blank 3 and divider 5. In one embodiment, the outer periphery 93 could be at least partially defined by the edges 17, 19, 21, 23 and/or the fold lines 33, 35, 45, 47, 49, 51, 61, 63, 65, 67 (e.g., depending on the folding of the end flaps). The central panel 11 and the article attachment flaps 75 could be otherwise shaped, arranged, configured, and/or omitted without departing from the disclosure.

In one embodiment, the central panel 11 has oblique fold lines 81 that are reinforcing scores that help prevent the central panel from curling when placed on the bottom layer 8 of containers C. The oblique fold lines 81 could be otherwise shaped, arranged, configured, and/or omitted without departing from the disclosure.

Figure 2:
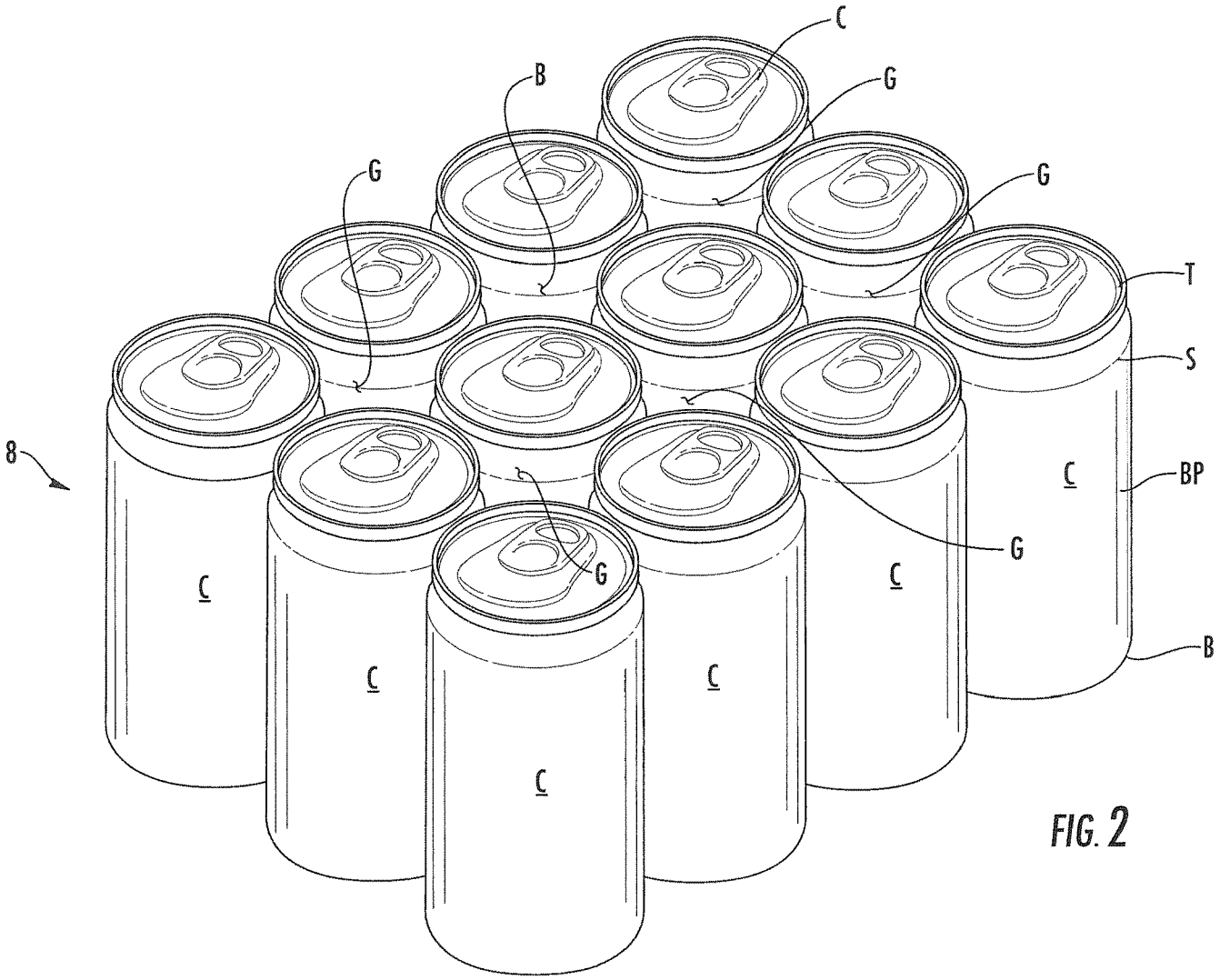
FIG. 2 is a perspective view of a first layer of containers according to the exemplary embodiment of the disclosure.
Figure 3:
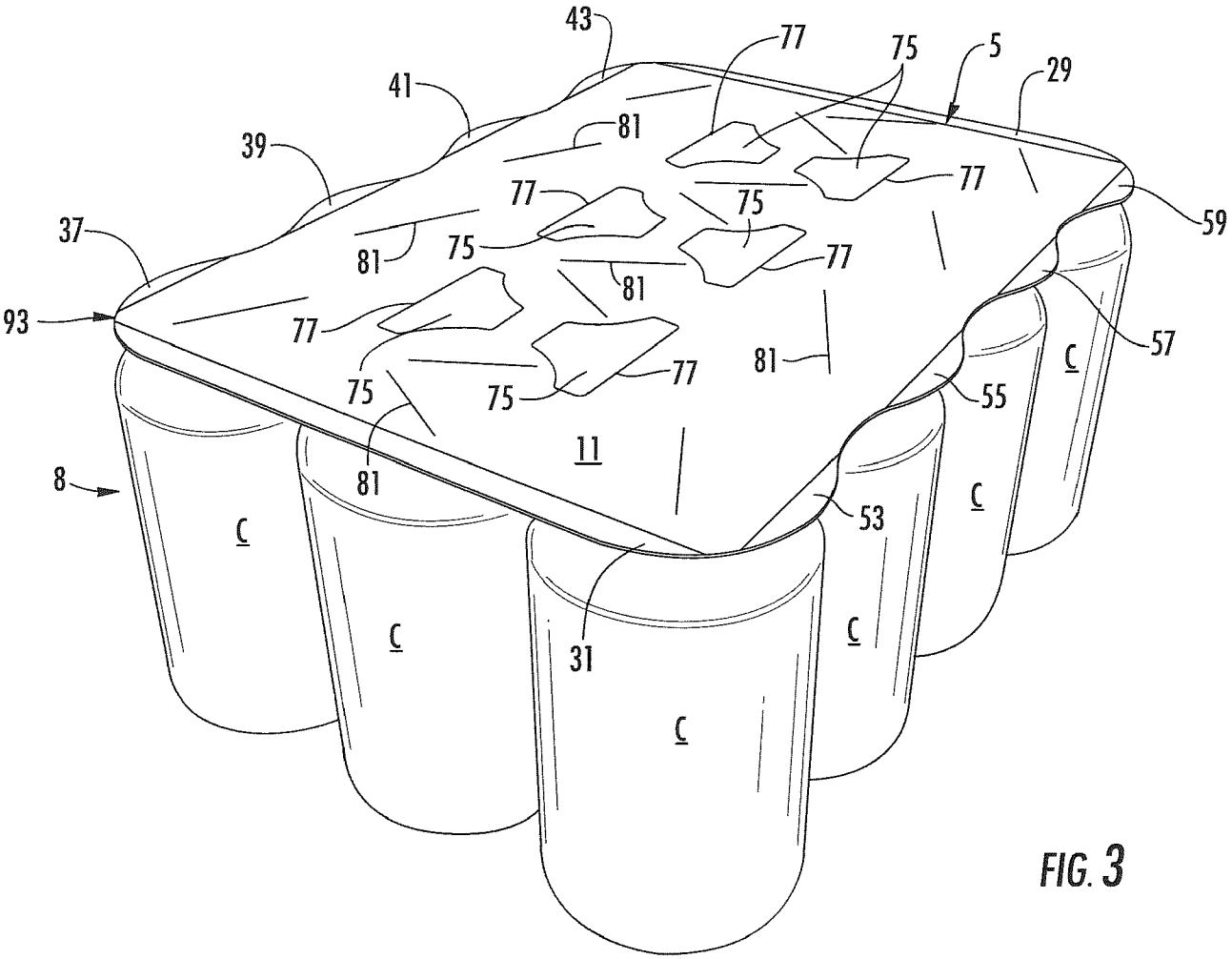
FIGS. 3 and 4 are perspective views of the divider on the first layer of containers according to the exemplary embodiment of the disclosure.

FIGS. 2-6 show one exemplary method of forming the package 7 with divider 5. As shown in FIG. 2, a group of containers C are first grouped and arranged in a 3×4 arrangement to form the first layer 8 of containers C with the adjacent containers in each row having gaps G between the containers. In one embodiment, the blank 3 is placed on top of the containers C to form the divider 5 as shown in FIG. 3. Alternatively, the containers C could be placed on the blank 3 without departing from the disclosure. The divider 5 could be otherwise shaped, arranged, configured, and/or omitted without departing from the disclosure.

Figure 4:
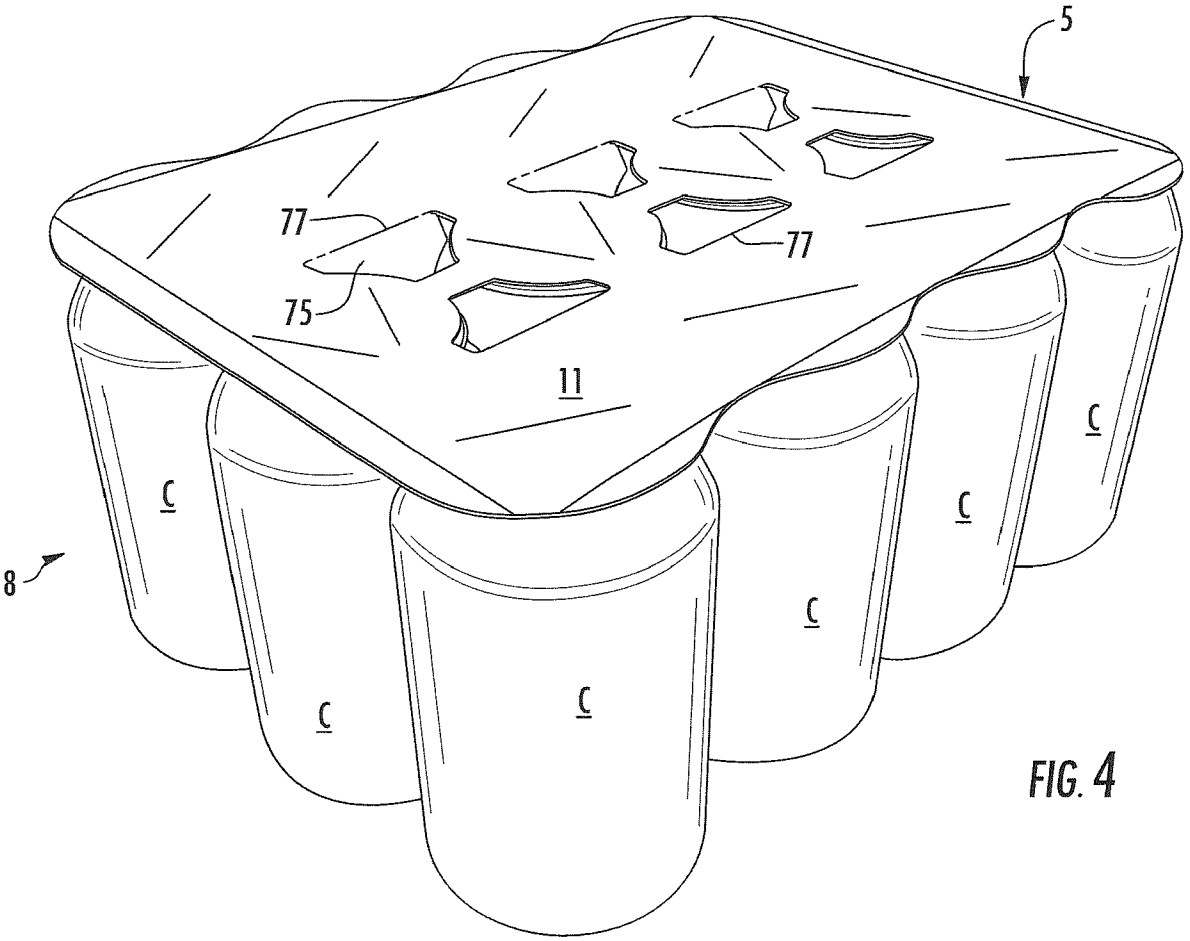
Figure 5:
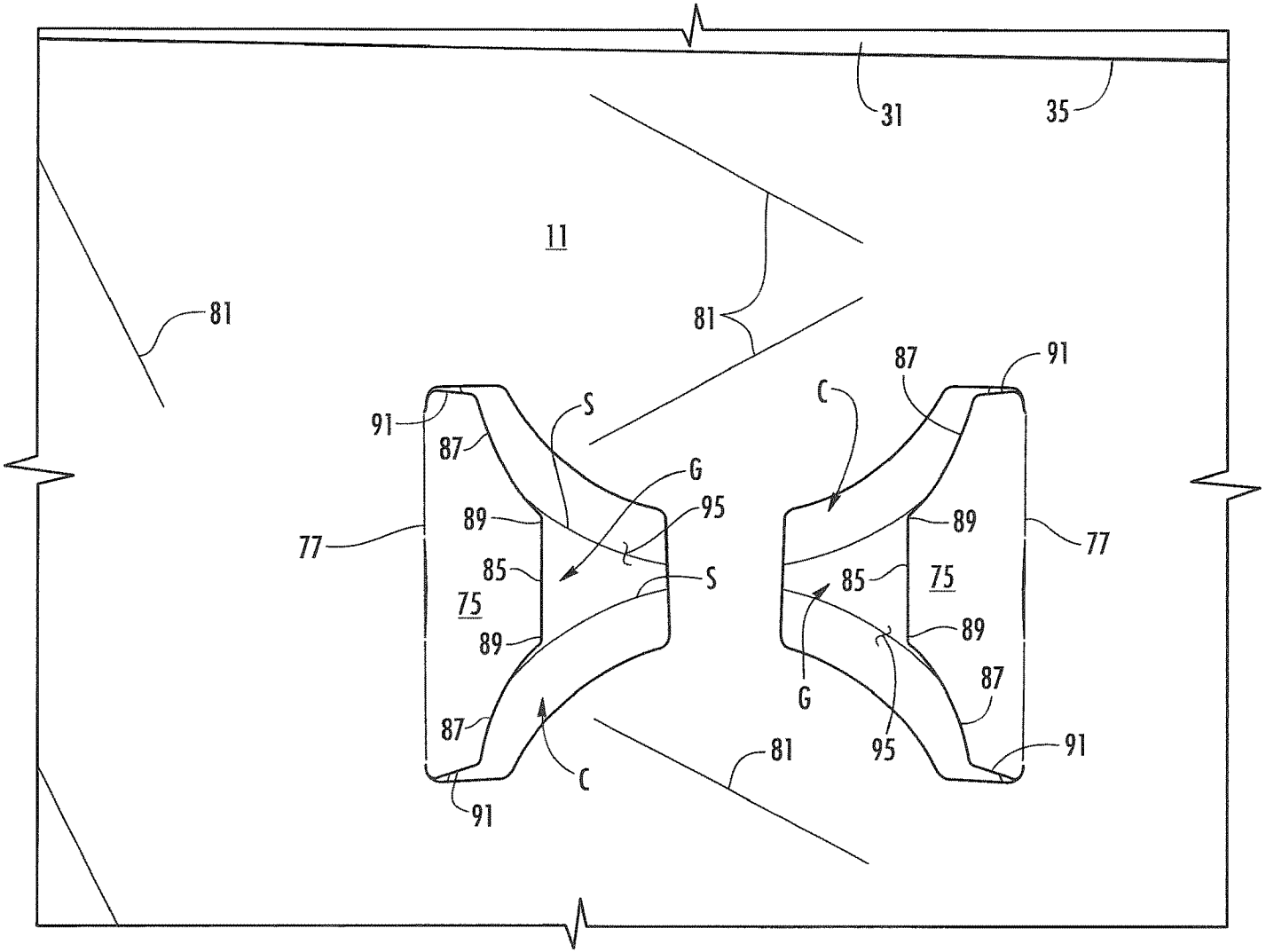
FIG. 5 is a top detail view of the divider of FIG. 4.
Figure 6:
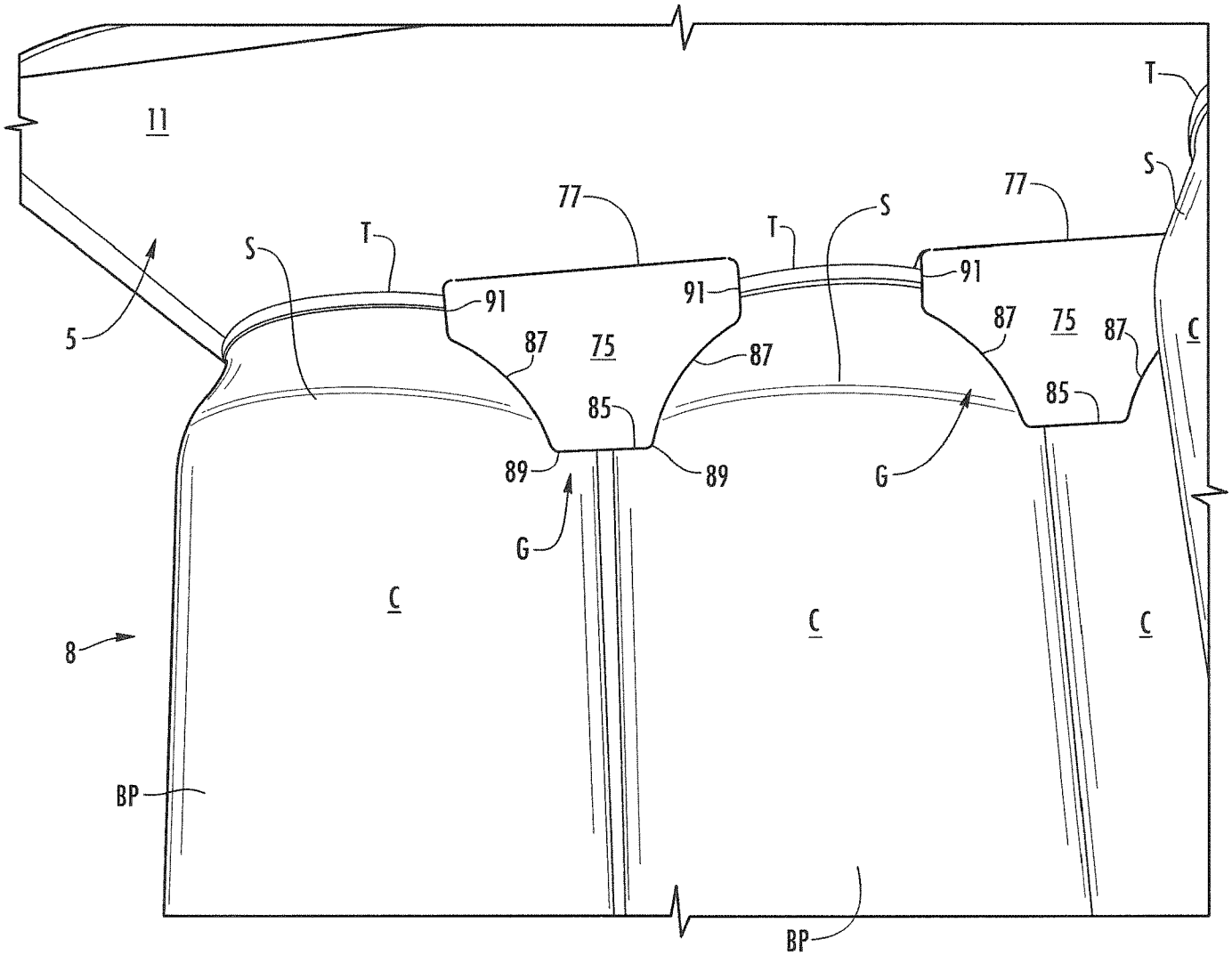
FIG. 6 is a perspective detail view of an underside of the divider according to the exemplary embodiment of the disclosure.

As shown in FIGS. 4-6, the article attachment flaps 75 can be downwardly folded along the respective fold lines 77 so that the flaps extend into the gaps G between adjacent containers and the divider 5 is at least partially secured to the containers in the first layer 8. As shown in FIG. 5, each of the article attachment flaps 75 can form a respective opening 95 in the central panel 11 when the article attachment flap is separated from the central panel along the respective cut lines 79. In one embodiment, each attachment flap 75 can be downwardly folded by pushing the longitudinal edge 85 and the curved edges 87 past the shoulders S of the containers C in the center row of the first layer 8 and adjacent the respective gap G so that the shoulders S are at least partially received by the respective curved edges 87. As shown in FIGS. 5 and 6, at least the ends 89 of the longitudinal edges 85 and/or portions of the curved edges 87 can engage and/or contact the body portions BP and/or the shoulders S of the containers C adjacent the respective gaps G and in the center row of the first layer 8 to help retain the article attachment flaps 75 in the respective gaps G. The downwardly folding of the article attachment flaps 75 helps to attach the divider 5 to the lower layer 8 of containers C so that the containers with attached divider can be further moved along a packaging line (not shown) to a location where the second layer 9 of containers is placed on top of the divider 5. The attachment flaps 75 can be sized and positioned to extend downwardly into the gaps G and contact adjacent articles of the lower layer of containers C to prevent the divider 5 from sliding relative to the containers. The article attachment flaps 75 could be otherwise folded without departing from the disclosure.

Figure 7:
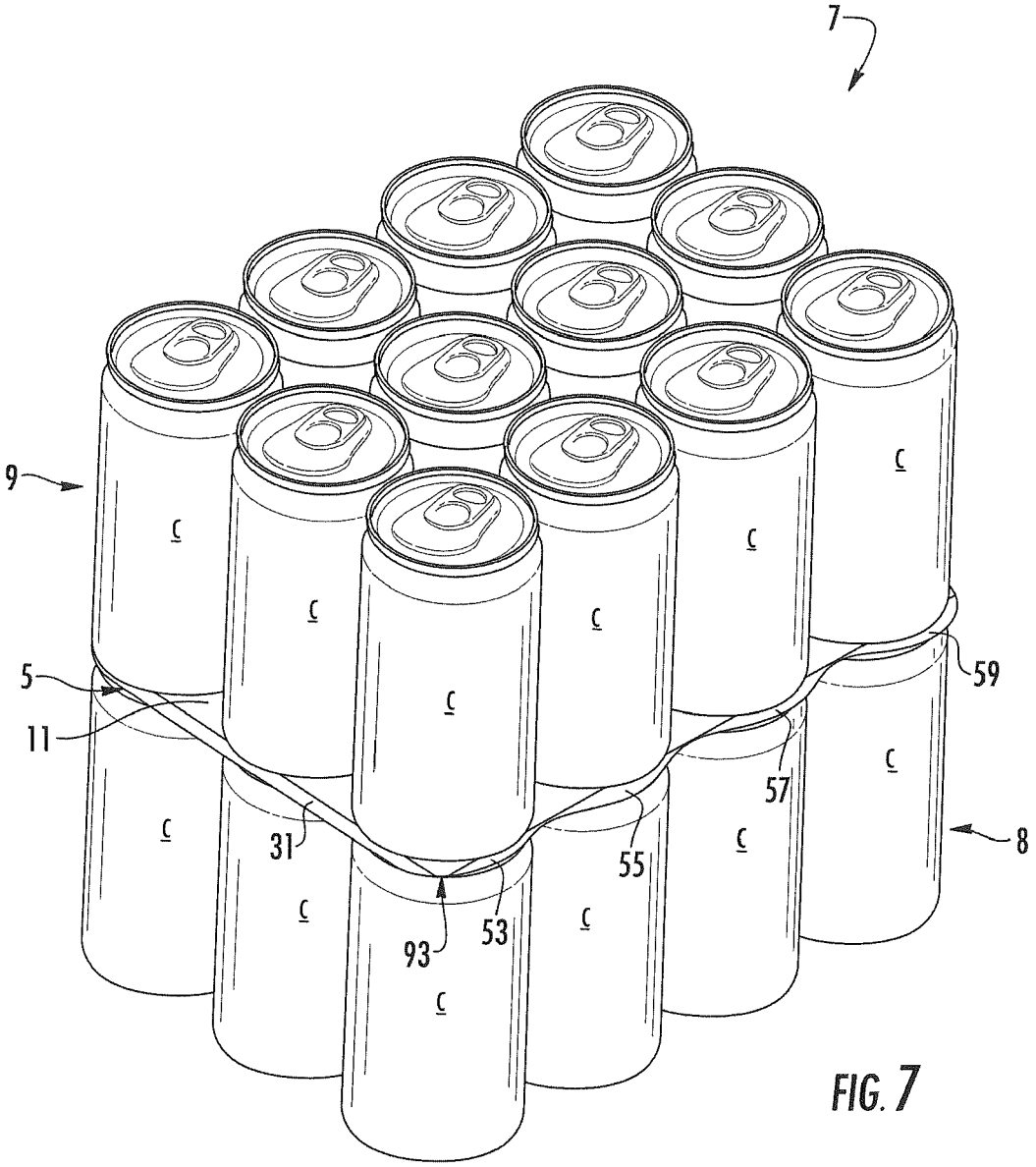
FIG. 7 is a perspective view of a package including the divider of FIG. 4 between two layers of containers according to the exemplary embodiment of the disclosure.
Figure 8:
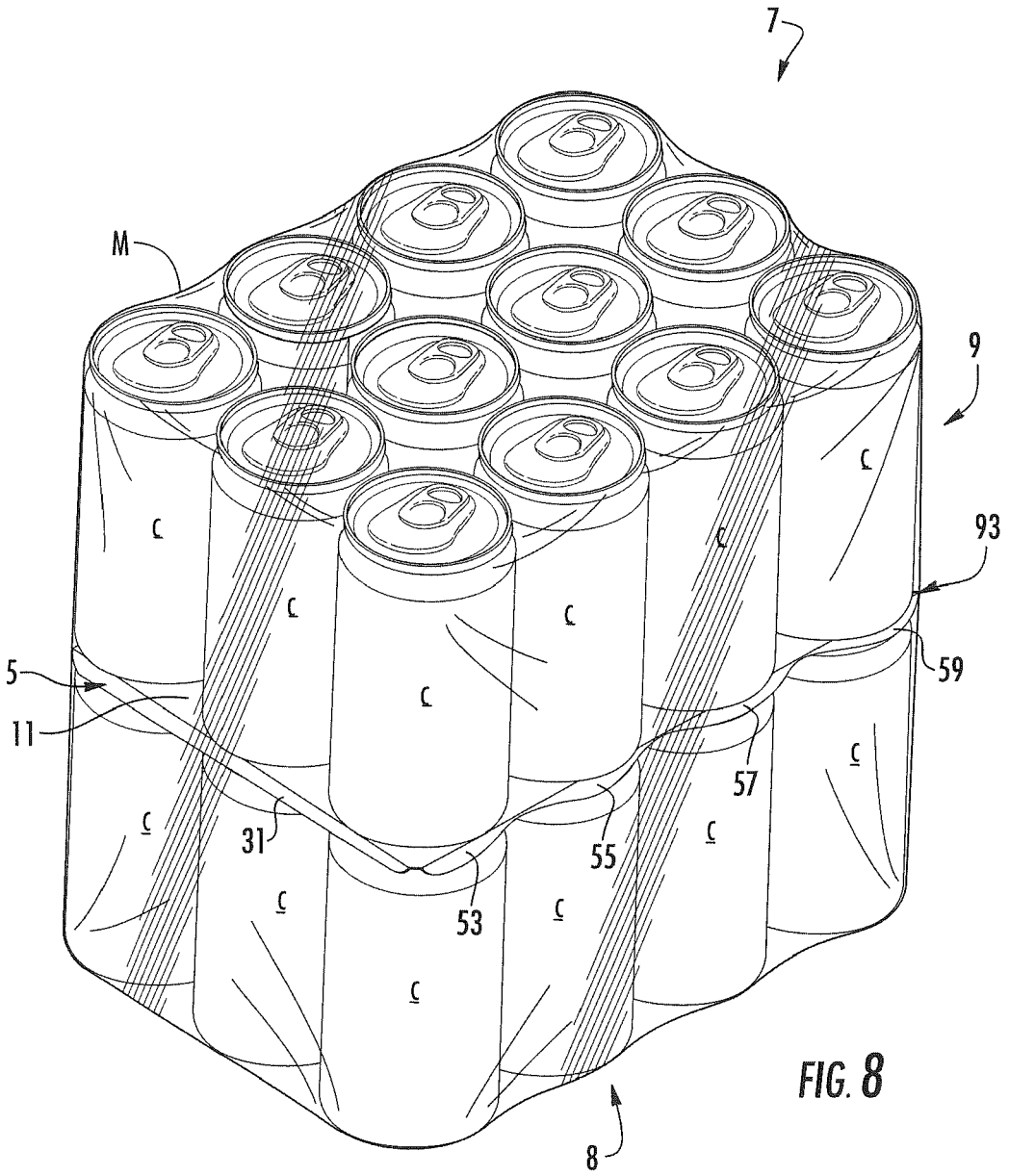
FIG. 8 is a perspective view of the package of FIG. 7 with an overwrap according to the exemplary embodiment of the disclosure.

As shown in FIG. 7, the second layer 9 of containers C can placed on top of the divider 5 so that the divider 5 is disposed between the layers 8, 9 of containers C. In one embodiment, the divider can contact the tops T of the containers in the first layer 8 and the bottoms B of the containers in the second layer 9. As shown in FIG. 8, the two stacked layers 8, 9 of containers C with the divider 5 therebetween can be secured together by an overwrap of shrink-wrap (e.g., flexible polymer film) M or other packaging material to form the package 7.

In one particular embodiment, one or more of the end flaps 29, 31 and one or more of the side end flaps 37, 39, 41, 43, 53, 55, 57, 59 can be downwardly or upwardly folded during the application of the packaging material M (FIG. 8). The end flaps 29, 31 and side end flaps 37, 39, 41, 43, 53, 55, 57, 59 are foldable to help prevent the edges of the divider 5 from penetrating or tearing the packaging material M when the divider 5 extends outward beyond the edges of the containers C.

In general, the blanks of any of the illustrated or non-illustrated embodiments may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, foil of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A method of forming a package comprising:

obtaining a divider comprising a central panel and at least one article attachment flap foldably connected to the central panel, the at least one article attachment flap comprises a longitudinal edge, a first curved edge, and a second curved edge, each of the first curved edge and the second curved edge extending from a respective end of the longitudinal edge;

obtaining a plurality of articles, each article of the plurality of articles is generally cylindrical;

arranging the plurality of articles into at least a first layer of articles and a second layer of articles, the first layer of articles defining at least one gap between at least two articles of the plurality of articles;

positioning the central panel of the divider against the first layer of articles; and folding the at least one article attachment flap relative to the central panel so that the at least one article attachment flap extends at least partially into the at least one gap.

2. The method of claim 1, wherein the folding of the at least one article attachment flap comprises engaging a respective one of the first curved edge and the second curved edge of the at least one article protection flap with a respective article of the at least two articles.

3. The method of claim 1, further comprising wrapping at least a portion of the first layer of articles, the divider, and the second layer of articles with an overwrap.

4. The method of claim 1, further comprising positioning the second layer of articles on the central panel of the divider so that the central panel is at least partially disposed between the first layer of articles and the second layer of articles.

5. The method of claim 1, wherein:

each article comprises a shoulder; and the folding the at least one article attachment flap comprises pushing at least a portion of the longitudinal edge, the first curved edge, and the second curved edge past the shoulder of the at least two articles adjacent the at least one gap so that the respective ends of the longitudinal edge engages a respective one of the at least two articles below the respective shoulder and the respective shoulders of the at least two articles are received in the respective first curved edge and second curved edge.

6. The method of claim 5, wherein the first curved edge of the at least one article attachment flap contacts the shoulder of a first article of the at least two articles and the second curved edge of the at least one article attachment flap contacts the shoulder of a second article of the at least two articles.

7. The method of claim 6, wherein the first article and the second article each comprise a cylindrical body portion that has a larger diameter than the shoulder of the first article and the second article, and the at least one article protection flap engages the cylindrical body portion of the first article and the second article.

8. The method of claim 1, wherein the at least one article attachment flap is foldably connected to the central panel along a longitudinal fold line that is spaced apart from an outer periphery of the divider.

9. The method of claim 8, wherein the folding the at least one article attachment flap comprises forming an opening in the central panel, the longitudinal fold line extends adjacent the opening, and the opening is spaced apart from the outer periphery of the divider.

* * * * *